US005375711A

United States Patent [19]

Bree et al.

[11] Patent Number: 5,375,711

[45] Date of Patent: Dec. 27, 1994

[54] BENT TOOTHBRUSH HOLDER

[76] Inventors: Lorraine Bree; Avery Bree, both of 10220 Murty La., Philadelphia, Pa. 19116

[21] Appl. No.: 31,100

[22] Filed: Mar. 8, 1993

[51] Int. Cl.[5] ..... B65D 83/10

[52] U.S. Cl. ..... 206/362.2; 206/361; 132/308

[58] Field of Search ..... 206/362.2, 361, 362.1, 206/362.3, 352, 349; 132/308, 309; D4/199

[56] References Cited

U.S. PATENT DOCUMENTS

| | | | |
|---|---|---|---|
| D. 338,123 | 8/1993 | Crawford | D4/199 |
| 543,028 | 7/1895 | Laws | 132/308 |
| 615,357 | 12/1898 | Johnson et al. | 206/362.3 |
| 634,906 | 10/1899 | McCloskey | 206/362.3 |
| 757,885 | 4/1904 | Cochrane | 206/209 |
| 943,415 | 12/1909 | Jones | 206/361 |
| 1,086,659 | 2/1914 | Ferenc | 206/362.2 |
| 1,134,524 | 4/1915 | Fowler | 206/361 X |
| 1,586,332 | 5/1926 | Scott | 132/308 X |
| 1,746,022 | 2/1930 | Barker | 132/308 |
| 1,864,874 | 6/1932 | Voight | 206/362.3 |
| 2,401,318 | 6/1946 | Robinson et al. | 132/308 |
| 2,601,244 | 6/1952 | Boulicault | 132/309 X |
| 3,746,162 | 7/1973 | Bridges | 206/361 |

FOREIGN PATENT DOCUMENTS

| | | | |
|---|---|---|---|
| 1009078 | 5/1952 | France | 206/361 |
| 0256706 | 8/1948 | Switzerland | 206/361 |

*Primary Examiner*—Paul T. Sewell
*Assistant Examiner*—Ted Kavanaugh

[57] ABSTRACT

A new and improved bent toothbrush holder apparatus is provided for a bent toothbrush having a straight handle, a brush holder portion, and an obtuse angular bend between the handle and the brush holder portion. The apparatus includes a straight cylindrical first holder portion which includes a first ventilation aperture and a first connector for connecting to a second holder portion. The first holder portion receives the handle of the bent toothbrush. The apparatus also includes a second holder portion which includes a first straight segment which includes a second ventilation aperture. The second holder portion also includes a second straight segment and an obtusely angled third segment connected between the first straight segment and the second straight segment. The second straight segment includes a second connector for connecting the second holder portion to the first connector on the first holder portion. The first straight segment of the second holder portion receives the brush holder portion of the bent toothbrush. Cross ventilation inside the apparatus is provided by air passing through the first ventilation aperture, through the interior of the apparatus, and out of the second ventilation aperture.

1 Claim, 4 Drawing Sheets

BENT TOOTHBRUSH HOLDER

BACKGROUND OF THE INVENTION

1. Field of the Invention

The present invention relates generally to holders for toothbrushes, and more particularly, to a toothbrush holder especially adapted to hold a bent toothbrush.

2. Description of the Prior Art

Toothbrushes having a handle and a brush portion arranged in a substantially straight line are well known in the art. Moreover, substantially straight toothbrush holders are known for holding such straight toothbrushes.

Toothbrushes having a handle and a brush portion arranged with respect to each other at an oblique angle along a bent line are also well known in The art. A prior art holder for a bent toothbrush is shown in U.S. Pat. No. 5,052,356 of Wilkinson. A problem with this holder is that it does not fully enclose the toothbrush. The toothbrush handle sticks out of the holder. By not completely enclosing the toothbrush, dirt can readily find its way to the bristle portion. It would be desirable, therefore, if a fully enclosed holder were provided for a bent toothbrush.

Another toothbrush holder is disclosed in U.S. Pat. No. 4,979,708 of Aoki. This holder does not enclose the toothbrush at all.

In the prior art portable dental kit of Manfredi in U.S. Pat. No. 4,527,574, a holder is provided for a toothbrush that is separable into two parts. A single ventilation hole is provided at one end of the holder. Ventilation of the holder is important for a number of reasons. Ventilation helps the toothbrush dry even when it is in the holder. Many microorganisms grow in warm and moist locations. Wet bristles of a toothbrush enclosed in an opaque toothbrush holder may provide such a warm, moist location for microbial growth. In this respect, it would be desirable if a bent toothbrush holder were provided that permitted improved ventilation to permit wet toothbrush bristles to dry.

Many microorganisms are air-borne; that is they are present on dust particles in the air. Such dust particles carry such air-borne microorganisms may find their way to wet toothbrush bristles as the bristles are ventilated by the air. It would be desirable, therefore, if a bent toothbrush holder were provided which filtered out dust particles to prevent microorganisms carried by the dust particles to find their way to the brush bristles.

Oftentimes people develop preferences for tooth cleaning compositions. When they travel, however, obtaining their favorite tooth cleaning composition my not be practical. Instead of carrying along a separate dispenser for a tooth cleaning composition, it may be desirable to carry a portion of the tooth cleaning material along with the toothbrush itself. For example, U.S. Pat. No. 4,269,207 of Konrad et al discloses a toothbrush which has a quantity of tooth cleaning material stored in the toothbrush handle. A internal channel in the toothbrush is provided for conveying some of the tooth cleaning material to the brush bristles from the handle. This is a quite complex arrangement and is not suitable for standard, off-the-shelf toothbrushes. In this respect, it would be desirable if a bent toothbrush holder were provided which were capable of storing off-the-shelf bent toothbrushes and which included a storage compartment for holding tooth cleaning material.

The concept of using a heat source for drying is well known in the art. For example, U.S. Pat. No. 4,880,021 of Haberstroh discloses heated hear for drying cans in a manufacturing process. The use of hair blow dryers are another example of the use heat for drying. In addition, hair blow dryers used forced air in addition to heat for drying. It this respect, it would be desirable if a bent toothbrush holder were provided that was adapted to employ heated forced air for drying the toothbrush retained in the holder.

Thus, while the foregoing body of prior art indicates it to be well known to use open toothbrush holders to store bent toothbrushes, the prior art does not disclose a simple and cost effective fully enclosed holder for a bent toothbrush. Also, the prior art does not provide satisfactory ventilation to permit wet toothbrush bristles to dry in an enclosed toothbrush holder. The prior art does not provide means for filtering out dust particles to prevent microorganisms carried by the dust particles to find their way to the brush bristles in a toothbrush holder. In addition, the prior art does not provide a holder which is capable of storing off-the-shelf bent toothbrushes and which includes a storage compartment for holding tooth cleaning material. The prior art does not provide a bent toothbrush holder that is adapted to employ heated forced air for drying the toothbrush retained in the holder. The foregoing disadvantages are overcome by the unique bent toothbrush holder apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved bent toothbrush holder apparatus for a bent toothbrush having a straight handle, a brush holder portion, and an obtuse angular bend between the handle and the brush holder portion. The apparatus includes a straight cylindrical first holder portion which includes a first ventilation aperture and a first connector for connecting to a second holder portion. The first holder portion receives the handle of the bent toothbrush. The apparatus also includes a second holder portion which includes a first straight segment which includes a second ventilation aperture. The second holder portion also includes a second straight segment and an obtusely angled third segment connected between the first straight segment and the second straight segment. The second straight segment includes a second connector for connecting the second holder portion to the first connector on the first holder portion. The first straight segment of the second holder portion receives the brush holder portion of the bent toothbrush. Cross ventilation inside the apparatus is provided by air passing through the first ventilation aperture, through the interior of the apparatus, and out of the second ventilation aperture.

More specifically, the first ventilation aperture is located on the first holder portion at a first end that is distal to the first connector. The second ventilation aperture is located on the first straight segment of the second holder portion at a second end that is distal to the second connection. The arrangement of the ventilation apertures permits ventilating air to pass from the first end to the second end within the first holder portion and the second holder portion.

In addition, the bent toothbrush holder apparatus of the invention may include a first filter, supported by an interior wall of the first holder portion adjacent to the first ventilation aperture, for filtering air that enters into the first holder portion through the first ventilation aperture. Similarly, the apparatus may also include a second filter, supported by an interior wall of the second holder portion adjacent to the second ventilation aperture, for filtering air that enters into the second holder portion through the second ventilation aperture.

The bent toothbrush holder apparatus may also include a storage receptacle assembly attached to an exterior surface of the second holder portion. The second holder portion and the storage receptacle assembly may be an integrated, unified structure. The storage receptacle assembly may include a container portion and a lid portion. The container portion and the lid portion may be connected together by a flexible hinge.

The bent toothbrush holder apparatus may also include an adaptor which includes a first end adapted to connect to the first end of the first holder portion, a flared middle connected to the first end, and a second end, connected to the flared middle, adapted to connect to a nozzle of a blow dryer.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved bent toothbrush holder apparatus which has all of the advantages of the prior art and none of the disadvantages.

It is another object of the present invention to provide a new and improved bent toothbrush holder apparatus which may be easily and efficiently manufactured and marketed.

It is a further object of the present invention to provide a new and improved bent toothbrush holder apparatus which is of durable and reliable construction.

An even further object of the present invention is to provide a new and improved bent toothbrush holder apparatus which is susceptible of a low cost of manufacture with regard to both materials and labor, and which accordingly is then susceptible of low prices of sale to the consuming public, thereby making such bent toothbrush holder apparatus available to the buying public.

Still yet a further object of the present invention is to provide a new and improved bent toothbrush holder apparatus that fully encloses a bent toothbrush.

Still another object of the present invention is to provide a new anti improved bent toothbrush holder apparatus that permits improved ventilation to permit wet toothbrush bristles to dry.

Yet another object of the present invention is to provide a new and improved bent toothbrush holder apparatus that filters out dust particles to prevent microorganisms carried by the dust particles to find their way to the brush bristles.

Even another object of the present invention is to provide a new and improved bent toothbrush holder apparatus which is capable of storing off-the-shelf bent toothbrushes and which includes a storage compartment for holding tooth cleaning material.

Still a further object of the present invention is to provide a new and improved bent toothbrush holder apparatus which is adapted to employ heated forced air for drying the toothbrush retained in the holder.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved bent toothbrush holder apparatus embodying the principles and concepts of the present invention will be described.

Figure 1:
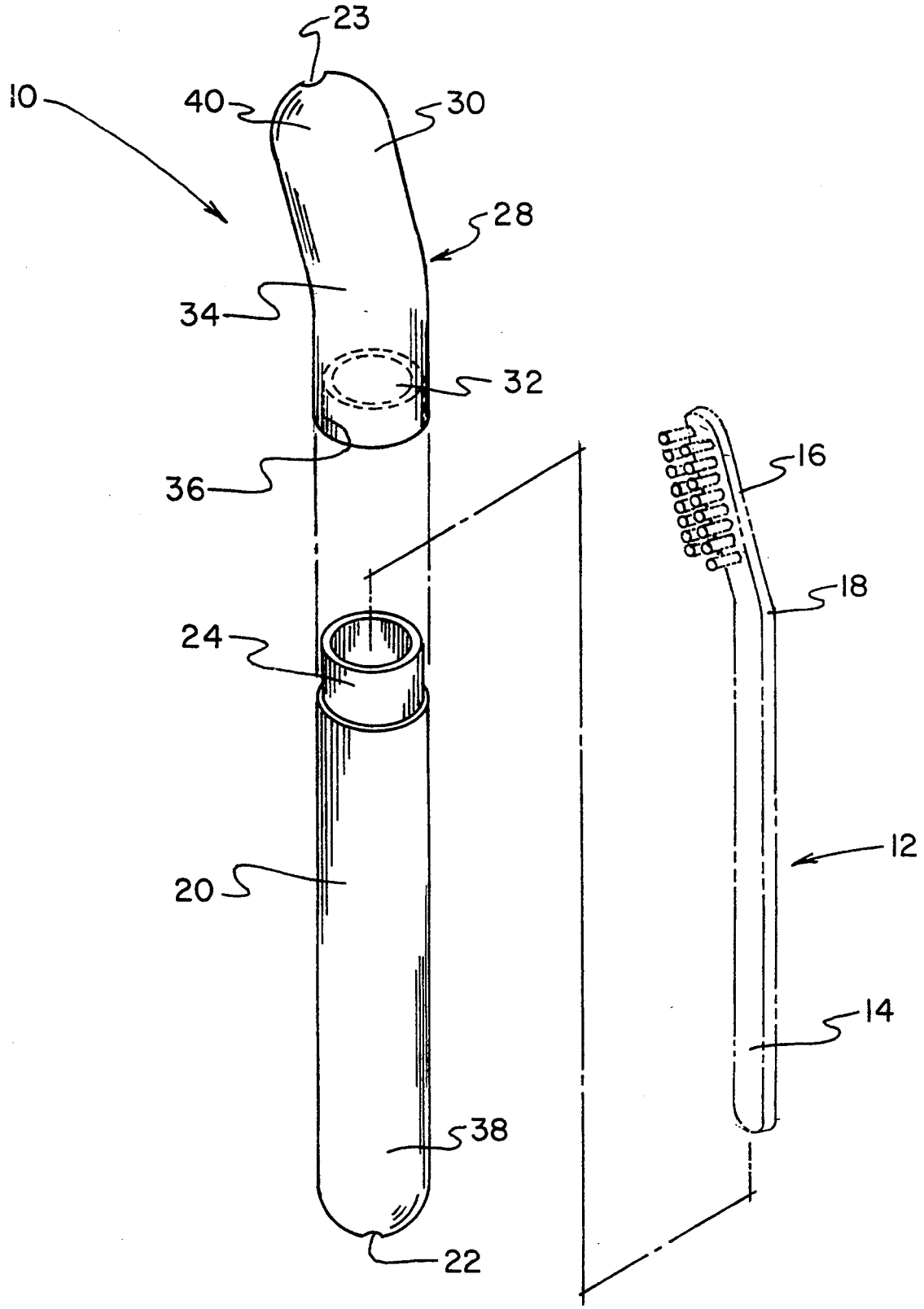
FIG. 1 is an exploded perspective view showing a first preferred embodiment of the bent toothbrush holder apparatus of the invention and a bent toothbrush in an open arrangement.
Figure 2:
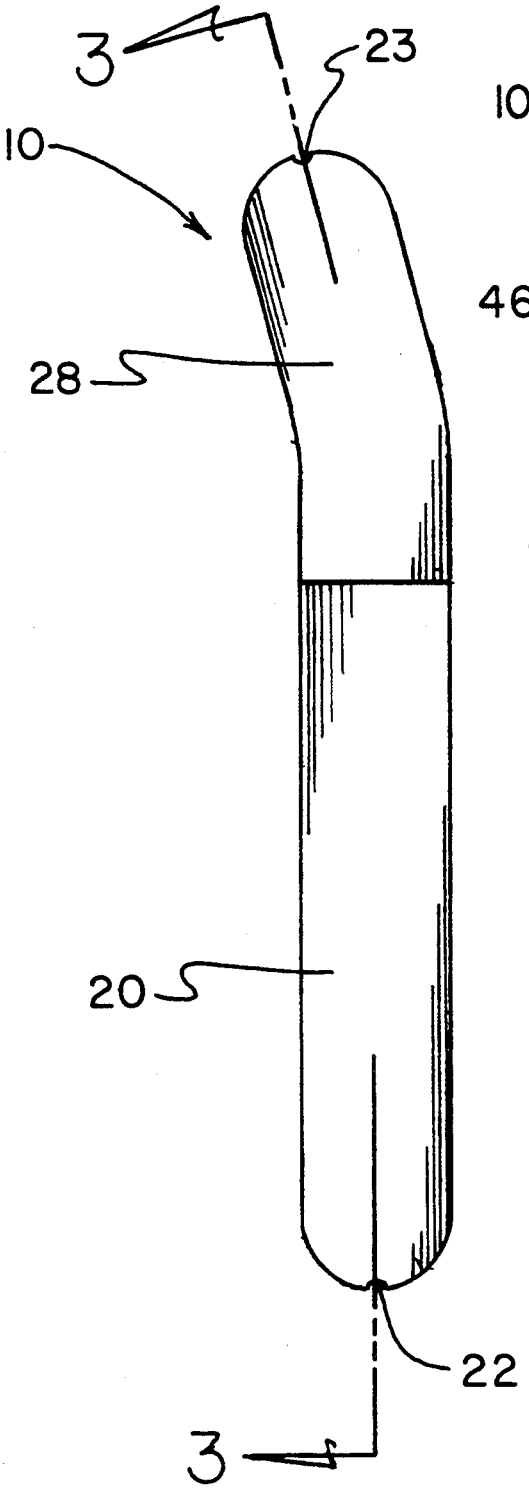
FIG. 2 is a cross-sectional elevational view of a second embodiment of the bent toothbrush holder apparatus in a closed arrangement.
Figure 3:
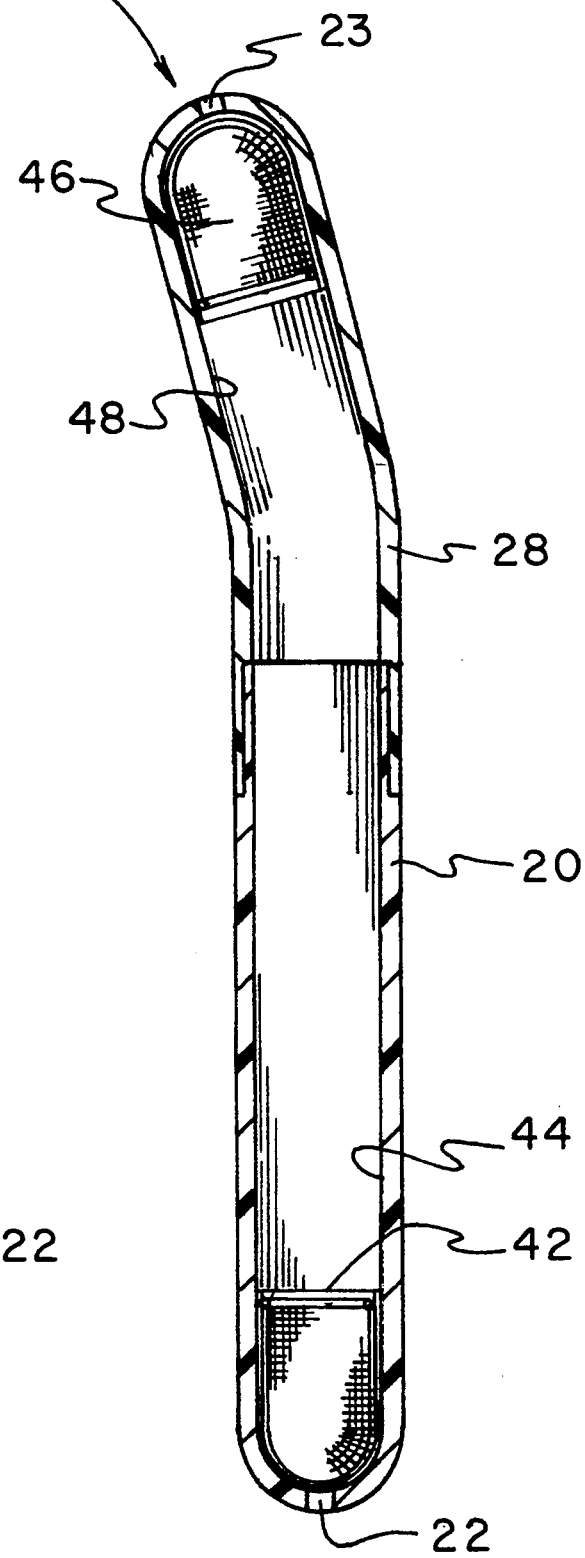
FIG. 3 is a cross-sectional view of the bent toothbrush holder apparatus of FIG. 2 taken along line 3—3 thereof.
Figure 4:
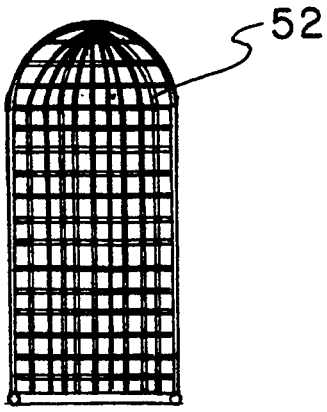
FIG. 4 is an enlarged view of a filter holder shown in FIG. 3.
Figure 5:
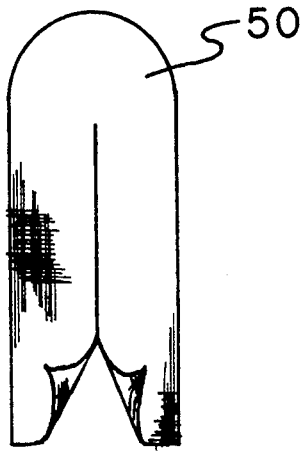
FIG. 5 is an enlarged view of a filter element shown in FIG. 3.

Turning initially to FIGS. 1–2, there is shown a first exemplary embodiment of the bent toothbrush holder apparatus of the invention generally designated by reference numeral 10.

The bent toothbrush holder apparatus 10 is for a bent toothbrush 12 having a straight handle 14, a brush holder portion 16, and an obtuse angular bend 18 between the handle 14 and the brush holder portion 16.

The apparatus 10 of the invention includes a substantially straight cylindrical first holder portion 20 which includes a first ventilation aperture 22 and first connecting portion 24 (shown as projecting flange 24) for connecting to a second holder portion 28. The first holder portion 20 receives the handle 14 of the bent toothbrush 12.

The second holder portion 28 includes a first straight segment 30 which includes a second ventilation aperture 23, a second straight segment 32, and an obtusely angled third segment 34 connected between the first straight segment 30 and the second straight segment 32. The second straight segment 32 includes a second connector 36 (shown as recess 36) for connecting the second holder portion 28 to the first connecting flange 24 on the first holder portion 20. The flange 24 and the recess 36 connect together by a friction fit. The first straight segment 30 receives the brush holder portion 16 of the bent toothbrush 12.

The first ventilation aperture 22 is located on the first holder portion 20 at a first end 38 that is distal to the first connecting flange 24, and the second ventilation aperture 23 is located on the first straight segment 30 of the second holder portion 28 at a second end 40 that is distal to the second connector, that is recess 36, whereby ventilating air can pass from the first end 38 to the second end 40 within the first holder portion 20 and the second holder portion 28. In this way, cross ventilation inside the apparatus is provided by air passing through the first ventilation aperture 22, through the interior of the apparatus 10, and out of the second ventilation aperture 23.

Turning to FIGS. 2–5, a second embodiment of the bent toothbrush holder apparatus of the invention is shown. Reference numerals are shown that correspond to like reference numerals that designate like elements shown in the other figures. In addition, a first filter 42, supported by an interior wall 44 of the first holder portion 20 adjacent to the first ventilation aperture 22, provides for filtering air that enters into the first holder portion 20 through the first ventilation aperture 22. Similarly, second filter 46, supported by an interior wall 48 of the second holder portion 28 adjacent to the second ventilation aperture 23, provides for filtering air that enters into the second holder portion 28 through the second ventilation aperture 23.

More specifically, the first filter 42 includes a first filter element 50 and a first filter element holder 52. Similarly, the second filter 46 includes a second filter element Oust like element 50) and a second filter element holder, (just like element 52). The filter element holders 52 may be a screen mesh. The filter elements 50 may be a cloth filter.

Figure 6:
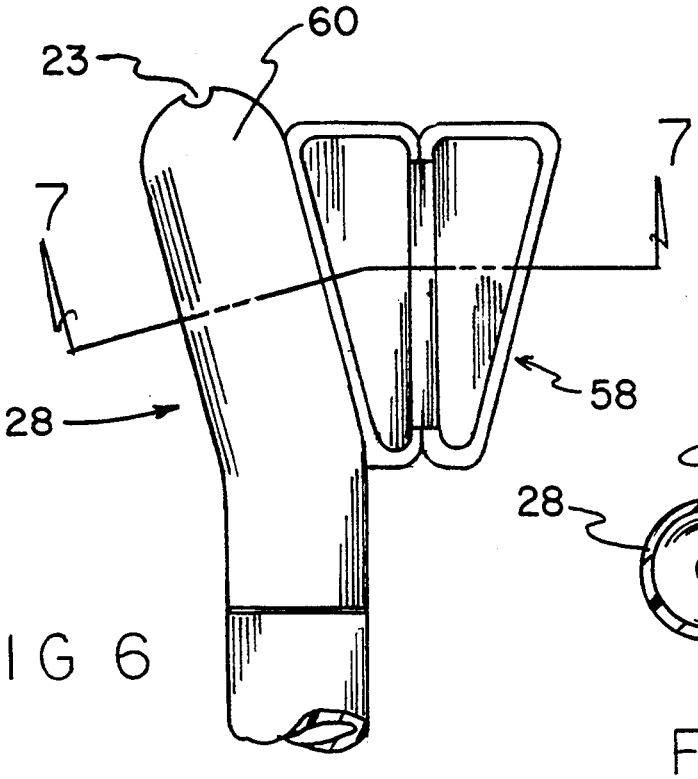
FIG. 6 is a side view of a third embodiment of the bent toothbrush holder apparatus of the invention showing a storage compartment for a tooth cleaning material.
Figure 7:
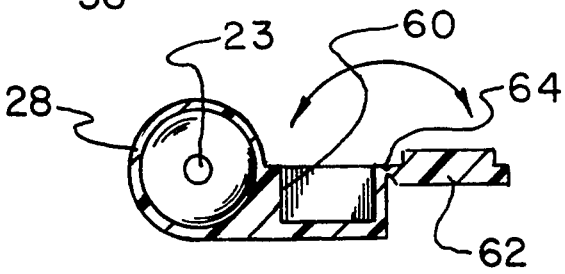
FIG. 7 is a cross-sectional view of the embodiment shown in FIG. 6 taken along the line 7—7 thereof.

Turning to FIGS. 6–7, a third embodiment of the bent toothbrush holder apparatus of the invention is shown. Reference numerals are shown that correspond to like reference numerals that designate like elements shown in the other figures. In addition, a storage receptacle assembly 58 is attached to an exterior surface 60 of the second holder portion 28. As shown, the second holder portion 28 and the storage receptacle assembly 58 are an integrated, unified structure. Preferably, most of the components of the bent toothbrush holder apparatus of the invention are made from inexpensive plastic materials.

The storage receptacle assembly 58 includes a container portion 60 and a lid portion 62. The container portion 60 and the lid portion 62 are connected together by of a flexible hinge 64.

Figure 8:
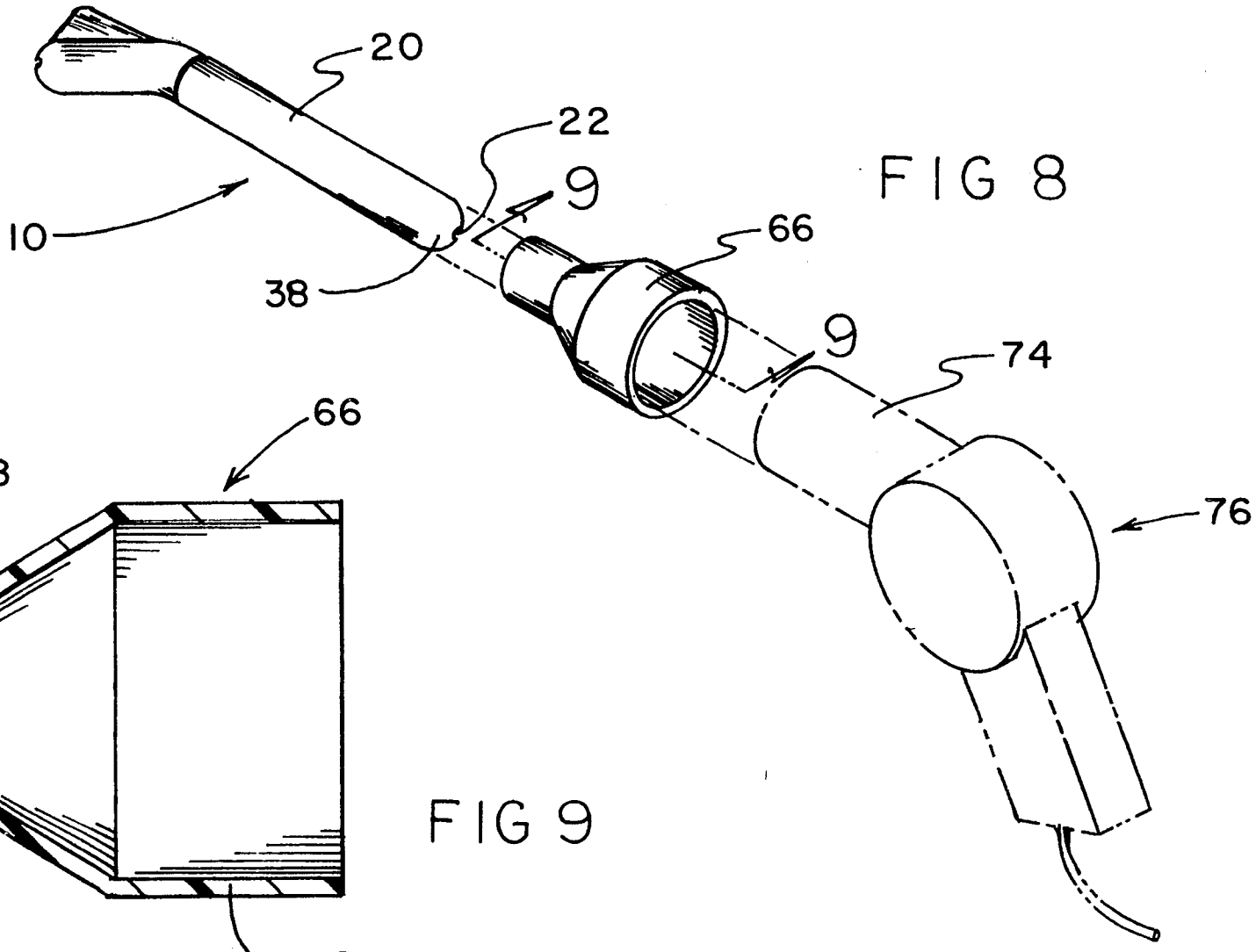
FIG. 8 is an exploded perspective view of a fourth embodiment of the bent toothbrush holder apparatus of the invention showing an adaptor that can connect with a blow dryer.
Figure 9:
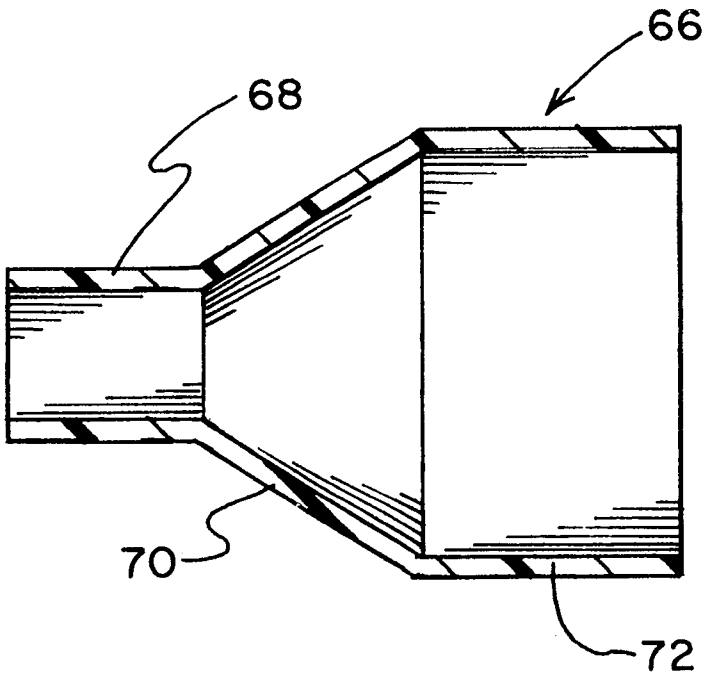
FIG. 9 is an enlarged cross-sectional view of the adaptor shown in FIG. 8 taken along line 9—9 thereof.

Turning to FIGS. 8–9, a fourth embodiment of the bent toothbrush holder apparatus of the invention is shown. Reference numerals are shown that correspond to like reference numerals that designate like elements shown in the other figures. In addition, a funnel-shaped adaptor 66 is provided which includes a first end 68 adapted to connect to the first end 38 of the first holder portion 20 (by a friction fit), a flared middle 70 connected to the first end 68, and a second end 72, connected to the flared middle 70, adapted to connect (by a fiction fit) to a nozzle 74 of an electric blow dryer 76.

The blow dryer 76 provides forced, heated air to the adaptor 66 and thence to the first ventilation aperture 22 of the first holder portion 20. The forced, heated air can pass through the interior of the first holder portion 20 and the second holder portion 28 and out through the second ventilation aperature 23 to rapidly dry a wet bent toothbrush retained in the bent toothbrush holder apparatus 10. In this way, cross ventilation by forced, heated air is obtained.

When filter elements are employed, use of the blow dryer provides cross ventilation of forced, heated, and filtered air for drying the bent toothbrush retained in the bent toothbrush holder apparatus of the invention.

It is apparent from the above that the present invention accomplishes all of the objects set forth by providing a new and improved bent toothbrush holder apparatus that is low in cost, relatively simple in design and operation, and which may advantageously be used to provide a fully enclosed holder for a bent toothbrush that permits cross ventilation of air for drying the bent toothbrush retained in the bent toothbrush holder apparatus of the invention.

With respect to the above description, it should be realized that the optimum dimensional relationships for the parts of the invention, to include variations in size, form function and manner of operation, assembly and use, are deemed readily apparent and obvious to those skilled in the art, and theretore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved bent toothbrush holder apparatus for a bent toothbrush having a straight handle, a brush holder portion, and an obtuse angular bend between the handle and the brush holder portion, the apparatus comprising:

a substantially straight cylindrical first holder portion which includes a first ventilation aperture, said first holder portion having a first closed end and an opposed, second end having an opening for receiving said straight handle of said bent toothbrush, said first ventilation aperture being located at said first end of said first holder portion, and a second holder portion which includes a first straight segment which includes a second ventilation aperture, a second straight segment, and an obtusely angled third segment connected between said first straight segment and said second straight segment, said second holder portion having a first closed end on said first straight segment thereof and an opposed second end having an opening for receiving said brush holder portion and obtuse angular bend of said bent toothbrush on said second straight segment thereof, said second ventilation aperture being located at said first closed end of said second holder portion, said first holder portion second end including first connecting means for connecting to said second holder portion, wherein said second straight segment of said second holder portion includes second connecting means for connecting said second holder portion to said first holder portion first connecting means, and wherein said first ventilation aperture is located on said first holder portion at a first end that is distal to said first connection means, and said second ventilation aperture is located on said first straight segment of said second holder portion at a second end that is distal to said second connection means, whereby ventilating air can pass from said first end to said second end within said first holder portion and said second holder portion, further including:

first filter means, supported by an interior wall of said first holder portion adjacent to said first ventilation aperture, for filtering air that enters into said first holder portion through said first ventilation aperture, second filter means, supported by an interior wall of said second holder portion adjacent to said second ventilation aperture, for filtering air that enters into said second holder portion through said second ventilation aperture, wherein said first filter means includes a first filter element and a first filter element holder, and wherein said second filter means includes a second filter element and a second filter element holder.

* * * * *